US005178450A

United States Patent [19]

Zelensky et al.

[11] Patent Number: 5,178,450

[45] Date of Patent: Jan. 12, 1993

[54] SELECTIVELY ILLUMINATED JAR

[76] Inventors: Marilyn E. Zelensky; Brian E. Zelensky, both of 48292 Sugarbush Rd., New Baltimore, Mich. 48047

[21] Appl. No.: 834,643

[22] Filed: Feb. 12, 1992

[51] Int. Cl.[5] ..... F21V 33/00; B65D 23/00

[52] U.S. Cl. ..... 362/154; 362/101; 362/155; 362/186; 362/802; 362/805; 362/806

[58] Field of Search ..... 362/155, 154, 186, 802, 362/805, 806, 101

[56] References Cited

U.S. PATENT DOCUMENTS

| | | | |
|---|---|---|---|
| D. 90,265 | 4/1933 | Shapiro | D26/94 |
| D. 223,720 | 5/1972 | Klupp | D26/94 |
| D. 268,210 | 3/1983 | Leeds | D26/94 |
| 1,921,570 | 8/1933 | Johnson | 40/431 |
| 2,415,514 | 4/1945 | Mayes | 362/311 |
| 2,470,612 | 11/1947 | Galter | 362/186 |
| 2,878,591 | 2/1958 | Harris | 434/291 |
| 3,144,992 | 8/1964 | Cheung | 362/190 |
| 4,323,879 | 4/1982 | Kelly | 362/157 |
| 4,390,928 | 6/1983 | Runge | 362/806 |
| 4,428,034 | 1/1984 | Seller | 362/186 |
| 4,922,355 | 5/1990 | Dietz et al. | 362/101 |

OTHER PUBLICATIONS

Simulated Miniature "Coleman" Lantern Key Chain -date unknown.

Detroit News, Detroit MI, Article Disclosing Subway Air Spray Cans dated before Feb. 1, 1992.

*Primary Examiner*—Ira S. Lazarus
*Assistant Examiner*—L. Heyman
*Attorney, Agent, or Firm*—Peter D. Keefe

[57] ABSTRACT

A selectively illuminated jar which truly exemplifies the happy mood associated with sunshine by operation of an illumination system within the jar. A clear plastic jar is connected at its top with screw-on cap. An illumination system located at the top of the jar includes a substantially semicircular lens which simulates a sun-like surface. Within the lens is a light bulb, a battery and a switch which selectively electrically connects the battery with the light bulb as the cap is screwed on with respect to the jar. Optionally, the bottom of the jar may have a reflective surface to increment the lighting effect of the jar. Further, the bottom portion of the jar may include a cup upon which selected writing may be placed, such as "Sunshine in a Jar". Alternatively, the writing may be placed directly upon the jar itself.

15 Claims, 1 Drawing Sheet

SELECTIVELY ILLUMINATED JAR

BACKGROUND OF THE INVENTION

1. Field of the Invention

The present invention relates to novelties, and more particularly to a jar provided with an illumination system which simulates the appearance of sunshine filling the jar.

2. Description of the Prior Art

During the long nights of the winter months, sunshine is regarded as a very precious commodity. For those persons shut-in to a bedroom because of illness or other difficulty, sunshine may not be readily accessible. For anyone in these circumstances, seeing sunshine is always a most welcome and happy experience.

In the prior art it is known to provide novelty items in the forms of cans which according to the exterior writing thereon may say, for instance, "Florida Sunshine". These novelty items achieve their desired effect on the users mood by the clever writing on the exterior of a can.

What is needed in the art is a container which truly exemplifies the mood desired to be conveyed by operation of the container itself rather than simply by exterior writing on the container.

SUMMARY OF THE INVENTION

The present invention is a selectively illuminated jar which truly exemplifies the happy mood associated with sunshine by operation of an illumination system within the jar.

The selectively illuminated jar according to the present invention is composed of a clear jar to which is connected a screw-on cap. An illumination system is located at the top of the jar, which includes a substantially semicircular translucent lens which simulates a sun-like surface. Within the lens is mounted a light bulb, a battery and a switch which selectively electrically connects the battery with the light bulb as the cap is screwed on with respect to the jar.

Optionally, the bottom of the jar may have a reflective surface to increment the lighting effect of the jar. Further the bottom portion of the jar may include a cup upon which selected writing may be placed, such as "SUNSHINE IN A JAR". Alternatively, the writing may be placed directly upon the jar itself.

Accordingly, it is an object of the present invention to provide a selectively illuminated jar which includes an interiorly located translucent lens which simulates sunshine within the jar.

It is an additional object of the present invention to provide a selectively illuminated jar in which the illumination is provided by an illumination system located adjacent the top portion of the jar and which is selectively actuated by screwing the cap selectively further on with respect to the jar.

These, and additional objects, advantages, features and benefits of the present invention will become apparent from the following specification.

DETAILED DESCRIPTION OF THE PREFERRED EMBODIMENT

Figure 1:
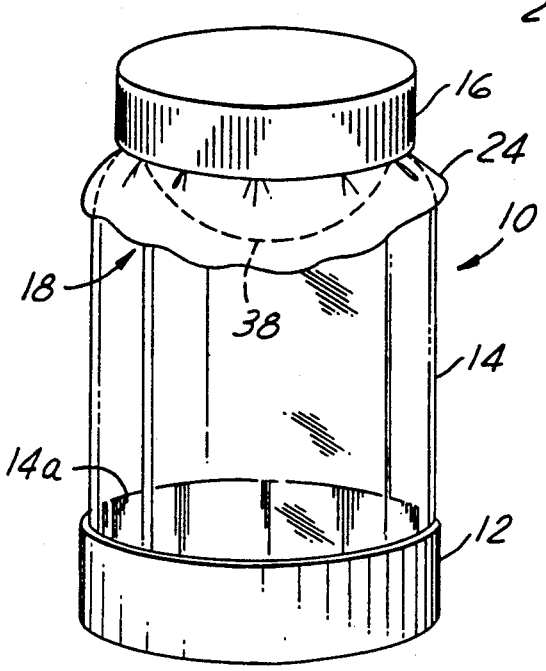
FIG. 1 is a perspective side view of a first preferred version of the selectively illuminated jar according to the present invention.
Figure 2:
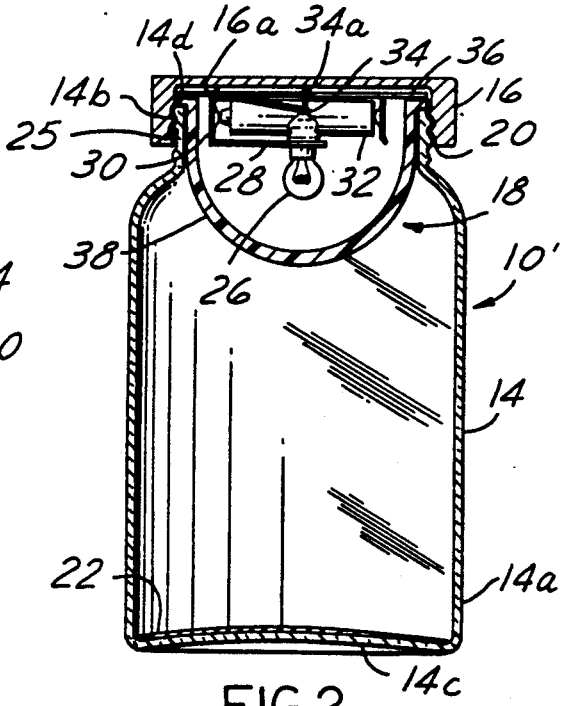
FIG. 2 is a partly sectional side view of a second preferred version of the selectively illuminated jar according to the present invention.
Figure 3:
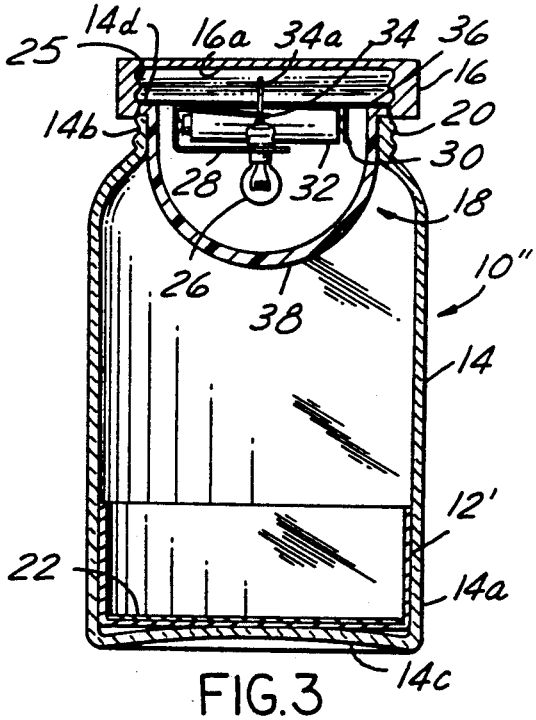
FIG. 3 is a partly sectional side view of a third preferred version of the selectively illuminated jar according to the present invention.
Figure 4:
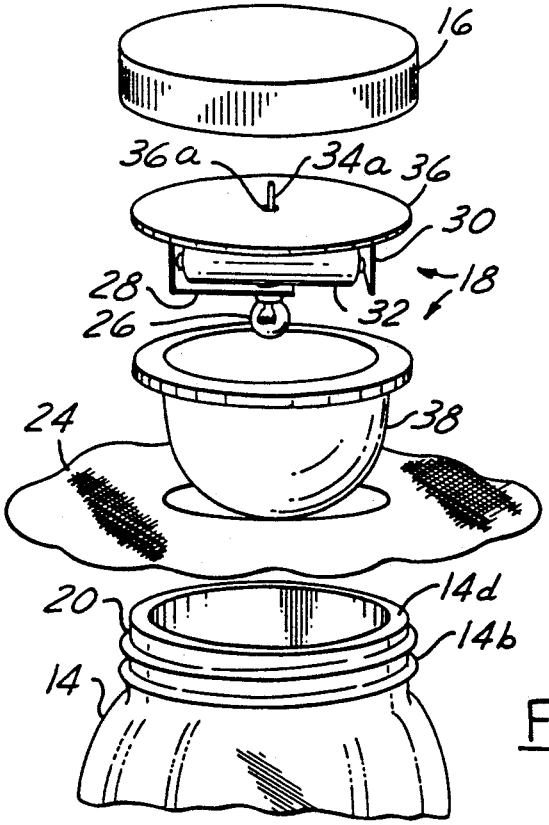
FIG. 4 is a detail exploded perspective side view of the illumination system of the selectively illuminated jar according to the present invention.

Referring no to the Drawing, FIG. 1 shows a first preferred version of the selectively illuminated jar 10, in which a cup 12 is located exteriorly at the bottom portion 14*a* of the jar 14. In this regard, FIG. 2 shows the selectively illuminated jar 10' without accompaniment of the cup 12, and FIG. 3 shows the selectively illuminated jar 10'' in which a cup 12' is located interiorly at the bottom portion 14*a* of the jar 14. Referring again to FIG. 1, it will be seen that the basic components of the selectively illuminated jar 10 are a light passable jar 14, a cap 16 which screws onto the top portion 14*b* (shown in FIG. 4) of the jar, and an illumination system 18 which is located adjacent the top portion 14*b* of the jar 14. The purpose of the illumination system 18 is to provide selectively operated illumination into the jar 14 so as to provide a pleasing sunlight-like effect.

The jar 14 is preferred to be of clear plastic construction. Other constructions are possible, though not as desirable; for instance the jar may be constructed of glass, and the jar may be other than clear. The top portion 14*b* of the jar is provided with threads 20.

The bottom portion 14*a* of the jar 14 may or may not be provided with a cup 12, 12', the cup extending partly up the jar from the jar bottom 14*c*. The cup 12, 12' is preferred to be of clear plastic construction and to either fit exteriorly to the jar, as in the cup 12 shown in FIG. 1, or, alternatively, fit interiorly to the jar, as in the cup 12' shown in FIG. 3. The cup 12, 12' is preferred to have printed thereupon descriptive information, such as "SUNSHINE IN A JAR". Alternatively, where the cup is absent, as shown in FIG. 2, the descriptive information may be placed directly upon the jar 14.

It is preferred for a silvered surface 22 to be provided at the jar bottom 14*c* for reflecting the light emanating from the illumination system 18. The silvered surface 22 may be placed upon the jar bottom 14*c* or placed upon the cup 12, 12' at the bottom thereof.

The cap 16 is provided with threads 25 which threadably engage the threads 20 of the top portion 14*b* of the jar 14. An apron 24, preferably of fabric construction and having a fanciful design, may optionally be provided which is structured for being trapped between the threads 20 and 25, and which extends partly down the jar from the top portion 14*b*. The apron 24 may be ruffled so as to provide a pleasing adjunct to the apprearance of the jar 14 and its cap 16.

The illumination system 18 is composed, generally, of a light bulb 26, a bulb mount 28 for the light bulb, a battery holder 30 for at least one battery 32, a switch 34, a mounting plate 36, and a curved lens 38. The light bulb 26 is preferred to be a standard incandescent bulb, but this is not a requirement. The light bulb 26 is replaceably connected to the bulb mount 28, such as by threading thereinto. The bulb mount 28 is connected to the mounting plate 36. The curved lens 38 is preferred to be of a translucent plastic construction, which may be white, yellow or clear. An annular lip 38*a* is connected with the curved lens and is structured for resting upon the top 14*d* of the jar 14. The curvature of the curved lens 38 is preferred to be generally semicircular. The mounting plate 36 is of circular cross-section and is structured to rest upon the annular lip 38*a*. The battery holder 30 is connected with the mounting plate 36 and is electrically connected with the light bulb 26 through the switch 34. The switch 34 is a momentary-type switch mounted to the mounting plate 36 and is actuated by depression of a push rod 34*a*. The push rod 34*a* is reciprocal through a hole 36*a* in the mounting plate 36 and is biased upwardly toward the cap 16 by the switch 34. As can be understood by reference to FIGS. 2 and 3, when the cap 16 is partly unscrewed, the push rod is not depressed so that the switch is in the off position (FIG. 3); however, when the cap is screwed a substantial amount onto the threads 20, the push rod depresses against the biasing action of the switch so as to actuate the switch (FIG. 2).

In operation, the user installs a battery into the battery holder, then adjusts the optional fabric apron for best placement. The cap is then screwed onto the threads of the jar partly. To turn on the illumination system, the cap is screwed further until the push rod depresses to the point of actuating the switch. To turn off the illumination system, the cap is partly unscrewed until the push rod no longer depresses to the point of actuating the switch.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A selectively illuminated jar, comprising:

a jar, said jar having a top and a top portion adjacent said top, said top portion being provided with threads, said jar having a bottom and a bottom portion adjacent said bottom;

a cap structured for threadably engaging said threads of said top portion of said jar; and illumination system means located adjacent said top portion of said jar for providing selective illumination of said jar, said illumination system including a curved lens through which said illumination is provided, said curved lens being convexly curved toward said bottom of said jar.

2. The selectively illuminated jar of claim 1, wherein said illumination system means comprises:

said curved lens having an annular lip structured to rest upon said top of said jar;

a mounting plate structured for resting upon said annular lip of said curved lens;

battery holder means connected with said mounting plate for holding at least one battery;

light bulb means for providing illumination;

light bulb holder means for holding said light bulb means with respect to said mounting plate and within said curved lens; and switch means for selectively electrically connecting said light bulb means with said battery holder means in response to selective threading of said cap onto said threads of said top portion of said jar.

3. The selctively illuminated jar of claim 2, wherein said switch means comprises a momentary switch and a push rod biasably connected with said momentary switch, said push rod being biased toward said cap, said push rod being depressed proportionately to screwing on and off of said cap with respect to said threads of said top portion of said jar, a first predetermined amount of said screwing of said cap resulting in said momentary switch being actuated, a second predetermined amount of said screwing of said cap resulting in said momentary switch being non-actuated.

4. The selectively illuminated jar of claim 2, wherein said curved lens is translucent and of substantially semicircular shape.

5. The selectively illuminated jar of claim 2, further comprising silvered surface means located at said bottom of said jar for providing reflection of light emanating from said illumination system means.

6. The selectively illuminated jar of claim 2, further comprising cup means located at said bottom portion of said jar for providing a surface on which indicia may be placed.

7. The selectively illuminated jar of claim 2, further comprising apron means structured to be trapped between said cap and said threads of said top portion of said jar for providing a pleasing apron effect adjacent said top portion of said jar.

8. A selectively illuminated jar, comprising:

a jar, said jar having a top and a top portion adjacent said top, said top portion being provided with threads, said jar having a bottom and a bottom portion adjacent said bottom;

a cap structured for threadably engaging said threads of said top portion of said jar; and an illumination system comprising:

a curved lens, said curved lens having an annular lip structured to rest upon said top of said jar, said curved lens being convexly curved toward said bottom of said jar;

a mounting plate structured for resting upon said annular lip of said curved lens;

battery holder means connected with said mounting plate for holding at least one battery;

light bulb means for providing illumination;

light bulb holder means for holding said light bulb means with respect to said mounting plate and within said curved lens; and switch means for selectively electrically connecting said light bulb means with said battery holder means in response to selective threading of said cap onto said threads of said top portion of said jar.

9. The selectively illuminated jar of claim 8, wherein said switch means comprises a momentary switch and a push rod biasably connected with said momentary switch, said push rod being biased toward said cap, said push rod being depressed proportionately to screwing on and off of said cap with respect to said threads of said top portion of said jar, a first predetermined amount of said screwing of said cap resulting in said momentary switch being actuated, a second predetermined amount of said screwing of said cap resulting in said momentary switch being non-actuated.

10. The selectively illuminated jar of claim 9, wherein said curved lens is translucent and of substantially semicircular shape.

11. The selectively illuminated jar of claim 10, further comprising silvered surface means located at said bottom of said jar for providing reflection of light emanating from said illumination system.

12. The selectively illuminated jar of claim 11, further comprising cup means located at said bottom portion of said jar for providing a surface on which indicia may be placed.

13. The selectively illuminated jar of claim 12, further comprising apron means structured to be trapped between said cap and said threads of said top portion of said jar for providing a pleasing apron effect adjacent said top portion of said jar.

14. The selectively illuminated jar of claim 10, further comprising cup means located at said bottom portion of said jar for providing a surface on which indicia may be placed, said cup means having silvered surface means located thereupon for providing reflection of light emanating from said illumination system.

15. The selectively illuminated jar of claim 14, further comprising apron means structured to be trapped between said cap and said threads of said top portion of said jar for providing a pleasing apron effect adjacent said top portion of said jar.

* * * * *